US007484285B2

(12) United States Patent
Kaneko et al.

(10) Patent No.: US 7,484,285 B2
(45) Date of Patent: Feb. 3, 2009

(54) SYSTEM FOR MATING AND DEMATING MULTIPLE CONNECTORS MOUNTED ON BOARD OF SEMICONDUCTOR TEST APPARATUS

(75) Inventors: Masanori Kaneko, Tokyo (JP); Hiroyuki Hama, Tokyo (JP); Takaji Ishikawa, Tokyo (JP); Shigeru Matsumura, Tokyo (JP)

(73) Assignee: Advantest Corp., Tokyo (JP)

( * ) Notice: Subject to any disclaimer, the term of this patent is extended or adjusted under 35 U.S.C. 154(b) by 339 days.

(21) Appl. No.: 10/505,652

(22) PCT Filed: Feb. 25, 2003

(86) PCT No.: PCT/JP03/02036

§ 371 (c)(1),
(2), (4) Date: Aug. 24, 2004

(87) PCT Pub. No.: WO03/075418

PCT Pub. Date: Sep. 12, 2003

(65) Prior Publication Data

US 2005/0081372 A1 Apr. 21, 2005

(30) Foreign Application Priority Data

Mar. 1, 2002 (JP) ..... 2002-056569

(51) Int. Cl.
*B25B 27/14* (2006.01)

(52) U.S. Cl. ..... 29/281.5; 29/281.4; 29/281.1; 29/281.6; 29/749; 29/757; 29/759

(58) Field of Classification Search ..... 29/281.1, 29/281.4, 281.5, 281.6, 749, 757, 758, 759, 29/760

See application file for complete search history.

(56) References Cited

U.S. PATENT DOCUMENTS 3,117,370 A * 1/1964 Kauppl et al. ..... 29/749
6,133,745 A * 10/2000 Yoon et al. ..... 324/755

FOREIGN PATENT DOCUMENTS

| | | |
|---|---|---|
| JP | 4-147700 | 5/1992 |
| JP | 04-147700 | 5/1992 |
| JP | 4-102594 | 9/1992 |
| JP | 08-136613 | 5/1996 |
| JP | 2000-195643 | 7/2000 |
| JP | 2001-155836 | 6/2001 |
| JP | 2002-025744 | 1/2002 |
| TW | 432761 | 5/2001 |

* cited by examiner

*Primary Examiner*—Rick K Chang
(74) *Attorney, Agent, or Firm*—Muramatsu & Associates

(57) ABSTRACT

A system for mating and demating a plurality of connectors mounted on a socket board with and from a plurality of corresponding connectors mounted on a motherboard includes: an adapter that is arranged above a surface opposite to the socket board surface on which the connectors are arranged and is movable in a direction in which the connectors are mated and demated; pressing means which contacts the surface of the socket board on which the semiconductor components are placed to press the socket board to the motherboard by lowering the adapter; and pulling means each of which engages with an engaging hole formed in the socket board and pulls the socket board in the direction in which the socket board is separated from the motherboard by lifting the adapter.

4 Claims, 8 Drawing Sheets

(a)

A-A CROSS SECTION (b)

(a)

B-B CROSS SECTION (b)

C-C CROSS SECTION (c)

(a)

(b)

SYSTEM FOR MATING AND DEMATING MULTIPLE CONNECTORS MOUNTED ON BOARD OF SEMICONDUCTOR TEST APPARATUS

TECHNICAL FIELD

The present invention relates to a jig for mating and demating a plurality of connectors mounted on a substrate (socket board) with and from a plurality of connectors mounted on a mate (motherboard) corresponding thereto. In particular, the present invention relates to a jig for mating and demating connectors which includes an adapter contacting and engaging with a substrate provided with connectors. By moving the adaptor forward and backward along a direction in which the connectors are mated and demated, the jig moves the substrate forward and backward in a direction in which the connectors are mated and demated thereby to mate and demate connectors with and from the connectors of the mate opposed thereto. Therefore, in a case where many connectors are provided, the jig can easily and surely mate and demate all the connectors at the same time and hence is suitable for mating and demating the connectors of a socket board or a self-diagnostic board removably mounted on the motherboard of a test apparatus of a semiconductor component.

BACKGROUND ART

In general, in a semiconductor testing apparatus for conducting a test on a semiconductor component, by placing a semiconductor component to be tested on a substrate called a socket board and connecting the socket board to a substrate called a motherboard on a test apparatus main body side, a predetermined electric signal necessary for conducting a test is inputted to or outputted from the socket board via the motherboard to conduct a test on the semiconductor component.

Here, in a conventional semiconductor testing apparatus, in order to give priority to electric performance, the socket board on which a semiconductor component is placed is electrically connected to the motherboard on a test apparatus main body side by wiring, soldering or the like, so that the socket board is integrally connected to the motherboard and hence can not be disconnected from the motherboard. The conventional semiconductor testing apparatus having such a structure that the socket board is integrally connected to and can not be disconnected from the motherboard presents a problem that since the socket board can not be independently disconnected or replaced, it is difficult to meet the test requirements for various kinds of semiconductor components undergoing major diversification.

In recent years, along with increasing complexity in the semiconductor components and progress in high package density, many semiconductor components having different package structures and pin structures have been developed and provided and hence in order to test the semiconductor components having various different structures, it is necessary to change the socket board which is an interface of the semiconductor component to the socket board corresponding to the pin structures and package structures of the respective semiconductor components. However, in the conventional semiconductor testing apparatus, as described above, the socket board is integrally connected to the motherboard of the apparatus main body side by soldering or the like and can not be disconnected from it, so that it is impossible to connect and disconnect or replace only the socket board. Thus, when tests are to be performed on different kinds of semiconductors, it is necessary to replace the whole test apparatus including the motherboard.

The conventional semiconductor that requires replacing the whole test apparatus, as described above, not only takes much time for using the new motherboards and elongates a test period, but also incurs increasing test cost and a waste of resources because it needs to introduce and replace expensive motherboards for the respective semiconductor components.

Thus, after an earnest research, the present applicant invented a semiconductor testing apparatus disclosed in Japanese Patent Application No. 2002-047186 in which by adopting connectors removably mated with each other as a connection structure of the socket board and the motherboard in the semiconductor testing apparatus, the socket board can be freely mated with and demated from the motherboard and can be replaced.

FIGS. 9(*a*) and 9(*b*) are an illustration conceptually showing a semiconductor testing apparatus proposed by the present applicant and disclosed in Japanese Patent Application No. 2002-047186, where FIG. 9(*a*) is a front view of the apparatus in a state where the socket board is removed from the motherboard and FIG. 9(*b*) is a bottom view of the socket board shown in FIG. 9(*a*).

As shown in these drawings, in this semiconductor testing apparatus, a motherboard 120 and a socket board 110 can be freely mated with and demated from each other. As for the socket board 110, a plurality of socket boards 110 are aligned on a plate to be a base and, as shown in FIG. 9(*b*), the socket board 110 has connectors 114*a*, 114*b*, 114*c*, 114*d*, . . . 114*n* mated with a connector (not shown) on the motherboard 120 side opposed thereto.

According to the semiconductor testing apparatus like this, the socket board 110 is removably connected to the motherboard 120 via the connectors 114*a* to 114*n*. Thus, for example, in a case where tests are made on semiconductor components that are different from each other in a package structure and a pin structure, it is possible to remove the socket board 110 from the motherboard 120 (refer to FIG. 9(*a*)) and to change only the socket board to a socket board corresponding to each semiconductor component.

Thus, in this semiconductor testing apparatus, it is possible to meet the test requirements for different kinds of semiconductor components by separately changing only the socket board and hence to eliminate need for changing the whole apparatus including the motherboard as required by the conventional apparatus. Therefore, a semiconductor testing apparatus having versatility could be realized at low cost.

By the way, as for the socket board mounted in the semiconductor testing apparatus, usually, a plurality of socket boards are aligned on the motherboard so as to conduct a test on many semiconductor components at the same time. Then, in the semiconductor testing apparatus of a board mating and demating type in accordance with the foregoing invention of the present applicant, a predetermined number of socket boards and connectors aligned on a frame are unified (refer to FIG. 9(*b*)) and the socket boards can be mated with and demated from the motherboard by a substrate unified in this manner (refer to FIG. 9(*a*)). Thus, all the connectors of the plurality of socket boards unified can be mated with and demated from the connectors of the motherboard corresponding thereto at the same time.

Here, usually, in a case where one connector is connected to another connector, it can be easily connected even manually, but in a case where many connectors are arranged on the same plane and are connected at the same time to a plurality of connectors of the mate corresponding thereto, all the connectors to be connected need to be moved to the mate along the direction in which they are mated and the plurality of connectors need to be mated with and demated from the connectors at the same time, so that as the connectors to be connected increase in number, an operation of mating and demating the connectors only by hand becomes difficult.

Further, in the semiconductor testing apparatus shown in FIGS. 9(*a*) and 9(*b*), the plurality of connectors are aligned on the same plane in correspondence to the plurality of socket boards. Thus, the operation of mating and demating the connectors only by hand becomes difficult and hence it is desired that some means for mating and demating connectors is developed. Therefore, as a result of further earnest research thereafter, the present applicant has reached an idea that in a case where a plurality of connectors are aligned on the same substrate, by developing a jig capable of moving back and forth the substrate along a direction in which the connectors are mated and demated, a load on the operation of mating and demating the connectors by hand can be reduced and minimized.

The present invention aims to solve the above problems. It is an object of the present invention to provide a jig for mating and demating connectors on a substrate, where the jig includes with an adapter contacting and engaging with the substrate provided with connectors. By moving the adaptor forward and backward along a direction in which the connectors are mated and demated, the substrate is moved forward and backward in a direction in which the connectors are mated and demated thereby to mate and demate connectors with and from the connectors of the mate opposed thereto. Even when many connectors are provided, the jig can easily and surely mate and demate all the connectors at the same time. The jig is particularly suitable for mating and demating the connectors of a socket board or a self-diagnostic board removably mounted on the motherboard of a test apparatus of a semiconductor component.

DISCLOSURE OF THE INVENTION

In order to achieve the above object, the present invention provides a jig for mating and demating a plurality of connectors mounted on the same surface of a substrate (socket board) with and from a plurality of connectors mounted on a mate (motherboard) corresponding thereto, and jig is so constructed as to include an adapter that is arranged opposite to a surface different from the surface of the substrate on which the connectors are arranged and is moved forward and backward in a direction in which the connectors are mated and demated, and pulling means that is mounted in a protruding manner on the adapter or the substrate and engages with an engaging hole formed in the substrate or the adapter and by moving the adapter backward, pulls the substrate in a direction in which the substrate is separated from the mate.

Further, in the present invention, the jig for mating and demating the connectors is so constructed as to include pressing means that is mounted in a protruding manner on the foregoing adapter (or the substrate) and contacts a surface different from a surface of the foregoing substrate (or the adapter) on which the connectors are arranged and by moving the foregoing adapter forward, presses the substrate to the foregoing mate.

According to the jig for mating and demating connectors of the present invention constructed in this manner, by moving the adapter having the pressing means abutting against the surface of the substrate provided with the plurality of connectors and the pulling means engaging with the engaging hole formed in the substrate backward along the direction in which the connectors are mated with respect to the substrate by the use of the lifting and lowering unit, the substrate can be moved forward with respect to the mate. This mates and demates the connectors placed on the substrate with and from the connectors of the mate along with the forward or backward movement of the adapter and hence in a case where the plurality of connectors are provided, all the connectors can be mated or demated by one operation.

Thus, according to the present invention, only by using the adapter having a simple construction, it is possible to easily and surely mate or demate all the connectors of the substrate with and from the all the connectors of the mate thereof. For example, as is the case with a semiconductor testing apparatus provided with a plurality of socket boards connected to the motherboard via the connectors, it is possible to automate an operation of mating and demating a plurality of connectors of a substrate with and from those of the mate thereof by the use of the jig in accordance with the present invention and hence to reduce a load on the operation of mating or demating the connectors by hand without the use of a complex apparatus at low cost.

Further, in the present invention, the jig for mating and demating connectors is constructed in such a manner that the foregoing pressing means resiliently contacts the foregoing substrate.

According to the jig for mating and demating connectors of the present invention constructed in this manner, the pressing means for pressing the substrate to the mate resiliently abuts against the substrate and hence can smoothly urge and press the substrate to the mate thereby to smoothly mate the connectors. That is, according to the pressing means that resiliently abuts against the substrate, it is possible to absorb shock applied to the substrate, the substrate of the mate, and the apparatus by resilience and to surely mate the connectors. Also by automatically mating and demating the connectors, it is possible to realize an operation of mating and demating the connectors with high reliability without breaking the substrate and the connectors.

Further, in the present invention, the jig for mating and demating connectors is constructed in such a manner that the foregoing pulling means has a shaft portion mounted in a protruding manner slidably with respect to the foregoing adapter and an bulging portion formed on a tip of the shaft portion and having a diameter larger than the shaft portion, and that the engaging hole of the foregoing substrate has a passing hole through which the bulging portion of the foregoing pulling means can pass and a sliding hole which is continuous with the passing hole and allows the shaft portion of the foregoing pulling means pass through but disallows the foregoing bulging portion to pass through, and that the bulging portion of the foregoing adapter passing through the passing hole of the foregoing engaging hole is moved to the foregoing sliding hole by sliding the foregoing shaft portion thereby to engage with the sliding hole such that it can not drop.

According to the jig for mating and demating connectors of the present invention constructed in this manner, it is possible to realize the pulling means for demating the mated connectors by a simple construction including the shaft portion and the bulging portion formed at the tip of the shaft portion and only by inserting the pulling means into the engaging hole of the substrate and sliding it, to engage the substrate with the adapter such that it can not drop and to pull the substrate from the mate. This makes it possible to provide the jig for mating and demating connectors that can demate the mated connectors only by the use of an extremely simple construction of the pulling means and the engaging hole, and can automate or facilitate the operation of mating and demating the connectors without a complex and large-sized apparatus, and is manufactured at low cost, and has a high degree of reliability.

In particular, in the present invention, the jig for mating and demating connectors is constructed in such a manner that the foregoing adapter has a base portion fixed to the foregoing substrate and a sliding portion slidable with respect to the base portion, and that the shaft portion of the foregoing pulling means is mounted in a protruding manner on the sliding portion of the foregoing adapter.

According to the jig for mating and demating connectors of the present invention constructed in this manner, since the pulling means engaging with the engaging hole of the substrate is mounted on the sliding portion of the adapter, by positioning and fixing the base portion of the adapter to the substrate and then sliding the sliding portion, it is possible to slide the pulling means in the engaging hole and to easily and surely engage the bulging portion with the engaging hole. This makes it possible to easily and surely slide the pulling means and in particular, also in a case where there are provided a plurality of pulling means, to slide all the pulling means and to engage them with the engaging holes by one operation of sliding the sliding portion, which results in mating and demating the connectors by the use of the jig in accordance with the present invention with a higher degree of efficiency.

Further, in the present invention, the jig for mating and demating connectors is constructed in such a manner that the foregoing adapter has a fixing means for fixing the foregoing sliding portion to the foregoing base portion such that the sliding portion can not slide with respect to the base portion.

According the jig for mating and demating connectors of the present invention constructed in this manner, it is possible to fix the sliding portion mounted on the base portion in such a way as to freely slide with respect to the base portion in such a manner that it can not slide, for example, by the use of fixing means such as a latch. Thus, by engaging the bulging portion of the pulling means with the substrate and then fixing the sliding portion to the base portion such that it can not slide, it is possible to prevent the bulging portion from dropping from the substrate and shifting in position involuntarily and hence to mate and demate the connectors with a higher degree of reliability.

Still further, in the present invention, the jig for mating and demating connectors is constructed in such a manner that the bulging portion of the foregoing pulling means is formed in a substantially spherical shape.

According to the jig for mating and demating connectors of the present invention constructed in this manner, since the bulging portion of the pulling means engaging with the engaging hole in such a way as to freely engage with and disengage from the engaging hole is so constructed as to be substantially spherical, it is possible to further smoothly engage and disengage the bulging portion with and from the engaging hole. That is, even if the shaft of the pulling means is mounted in any way, it is possible to surely engage the spherical bulging portion with the edge of the engaging hole and to absorb a shift in position in the engaging hole. This makes it possible to easily assemble the adapter and to surely pull the substrate, which can provide a jig of high reliability at low cost.

The motherboard of a semiconductor testing apparatus receives and applies a predetermined electric signal from and to the socket board. The present invention further provides a semiconductor test apparatus comprising a socket board capable of loading electric devices to be tested, and having an engaging hole, a motherboard that receives and applies a predetermined electric signal from and to the socket board, an adapter capable to moving upward and downward, and pulling means that is mounted in a protruding manner on the adapter and is designed to engage with the engaging hole formed on the socket board. The adaptor enables to mate the socket board and the motherboard.

According to the jig for mating and demating connectors of the present invention constructed in this manner, since the substrate and its mate of which the connectors are mated and demated by the use of the adapter are the socket board and the motherboard of the semiconductor testing apparatus, it is possible to apply the jig of the present invention to the semiconductor testing apparatus of a socket board mating and demating type. Thus, in the semiconductor testing apparatus capable of responding to a test on various kinds of semiconductor components by singly changing only the socket board, it is possible to automate the operation of mating and demating the socket board with and from the motherboard by the use of the jig of the present invention and to reduce a load on the operation of mating and demating the connectors by hand and to conduct the test on the semiconductor components with a high degree of efficiency.

BEST MODE FOR CARRYING OUT THE INVENTION

Hereafter, the preferred embodiment of a jig for mating and demating connectors in accordance with the present invention will be described with reference to FIGS. 1 to 8.

Figure 1:
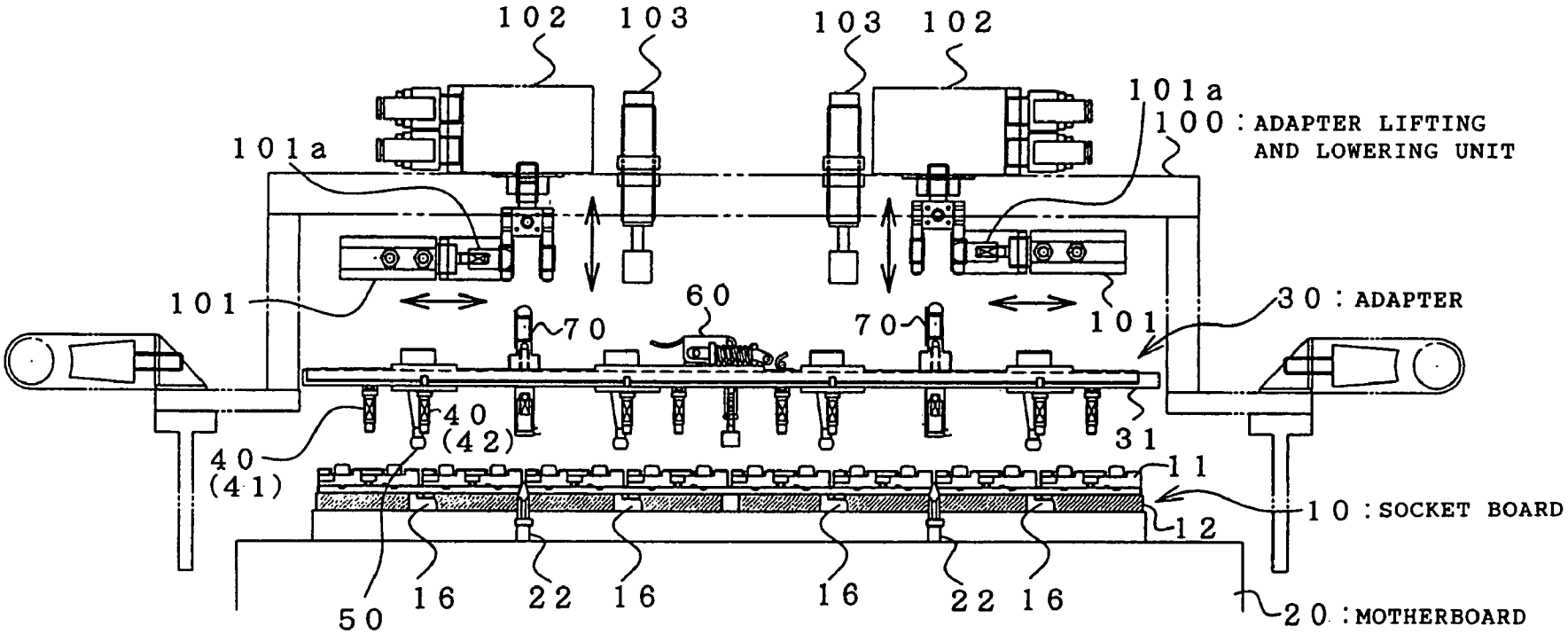
FIG. 1 is a schematic front view showing an overall structure of a semiconductor testing apparatus to which a jig for mating and demating connectors in accordance with one embodiment of the present invention is.

FIG. 1 is a schematic front view showing an overall structure of a semiconductor testing apparatus to which the jig for mating and demating connectors in accordance with one embodiment of the present invention is applied. As shown in the figure, the jig is so configured for mating and demating a plurality of connectors placed on the same plane of a substrate with and from a plurality of connectors on the mate corresponding thereto and, to be more specific, the semiconductor testing apparatus has a socket board 10 and a motherboard 20 with which the socket board 10 is mated An adapter 30 and an adapter lifting and lowering unit 100 are mounted to form the jig for mating and demating a plurality of connectors 14, 21 (refer to FIG. 2) for electrically connecting the socket board 10 to the motherboard 20.

[Socket Board and Motherboard]

Figure 2:
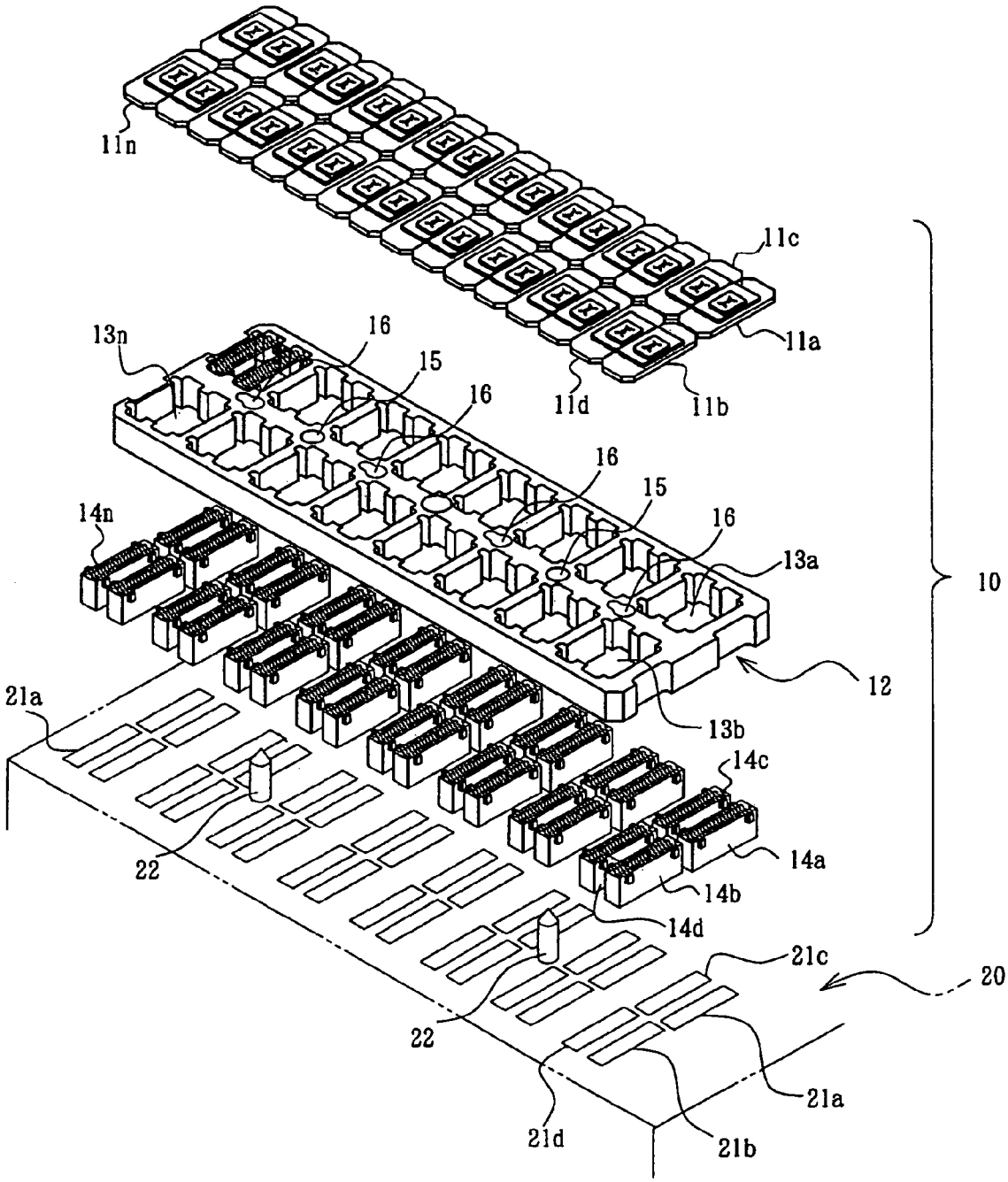
FIG. 2 is an exploded perspective view showing a socket board and a motherboard mounted on the semiconductor testing apparatus to which the jig for mating and demating connectors in accordance with one embodiment of the present invention is applied.
Figure 3:
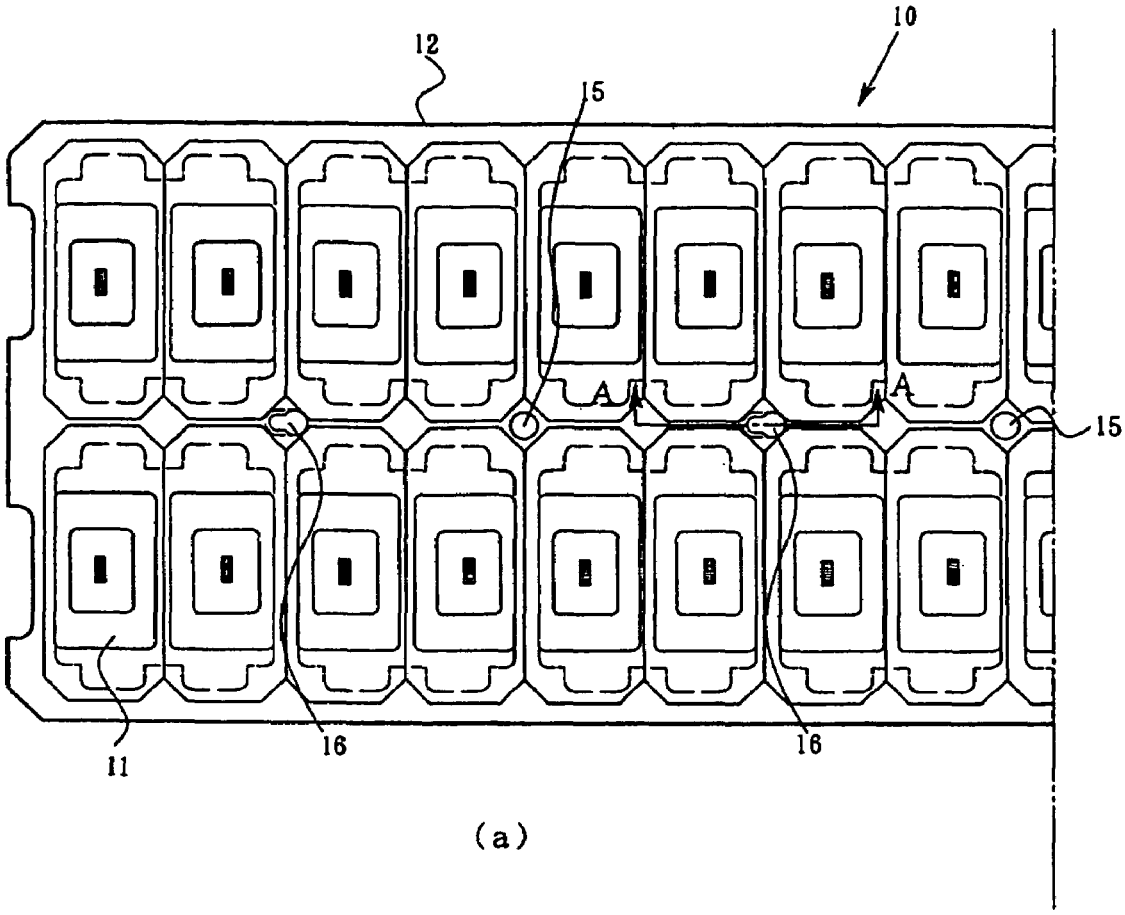
FIGS. 3(*a*) and 3(*b*) show a socket board mounted on the semiconductor testing apparatus to which the jig for mating and demating connectors in accordance with one embodiment of the present invention is applied, where FIG. 3(*a*) is a partial plan view and FIG. 3(*b*) is a cross-sectional view taken along line A-A in FIG. 3(*a*).
Figure 3:
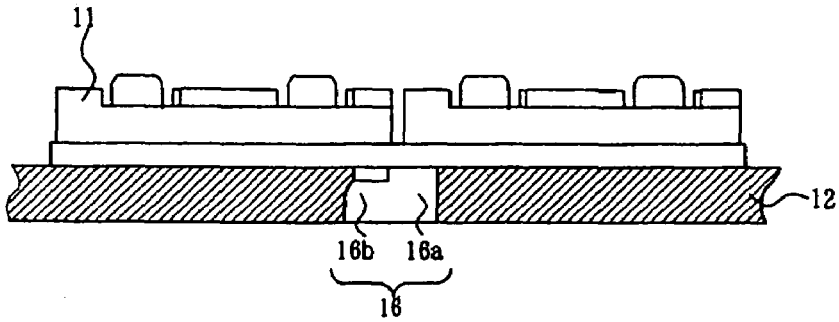

First, the socket board 10 and the motherboard 20 mounted on the semiconductor testing apparatus in accordance with the present embodiment will be described with reference to FIGS. 2 and 3. FIG. 2 is an exploded perspective view showing the socket board 10 and the motherboard 20 mounted on the semiconductor testing apparatus to which the jig for mating and demating connectors in accordance with one embodiment of the present invention is applied. FIGS. 3(*a*) and 3(*b*) show the socket board 10 in accordance with the present embodiment where FIG. 3(*a*) is a partial plan view and FIG. 3(*b*) is a cross-sectional view taken on a line A-A in FIG. 3(*a*).

Figure 9:
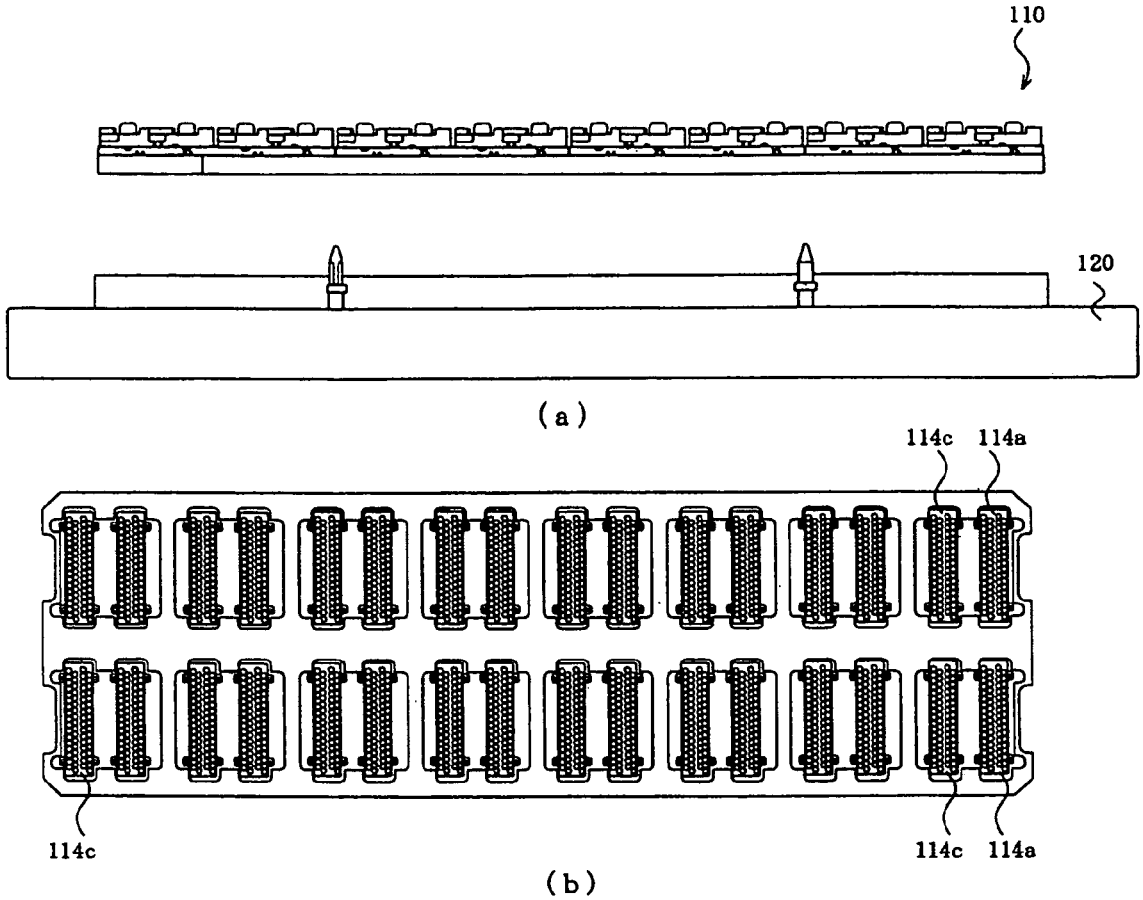
FIGS. 9(*a*) and 9(*b*) are illustrations for conceptually describing a semiconductor testing apparatus proposed by the present applicant in Japanese Patent Application No. 2002-047186, where FIG. 9(*a*) is a front view showing a state where the socket board is demated from the motherboard, and FIG. 9(*b*) is a bottom view of the socket board shown in FIG. 9(*a*).

As shown in these figures, the semiconductor testing apparatus in accordance with the present embodiment, as with the semiconductor testing apparatus shown in FIGS. 9(*a*) and 9(*b*), are a test apparatus that is so constructed as to be able to freely mate and demate the socket board 10 on which semiconductor components (not shown) to be tested are mounted with and from the motherboard 20 and by separately changing only the socket board 10, thereby enabling to meet the test requirements for different kinds of semiconductor components.

In the socket board 10, as shown in FIG. 2, a plurality of socket boards 11*a*, 11*b*, 11*c*, 11*d*, . . . , and 11*n* are integrally unified. To be more specific, in the unified socket board 10, the plurality of socket boards from 11*a* to 11*n* are aligned in a row on a socket board frame (SB frame) 12, which is to be a base plate, and connectors 14*a*, 14*b*, 14*c*, 14*d*, . . . , 14*n* to be connected to the socket boards from 11*a* to 11*n* are arranged in spaces 13 (13*a*, 13*b*, . . . , 13*n*) of the SB frame 12.

Each of the respective socket boards from 11*a* to 11*n* is a substrate having a part mounting and connecting portion (socket portion) on which a semiconductor component to be tested is mounted and which electrically connects the semiconductor component and one semiconductor component is mounted on each of the socket boards from 11*a* to 11*n*. Then, this plurality of socket boards from 11*a* to 11*n* are mounted on and fixed to the respective frame portions of the SB frame 12.

The SB frame 12 is a frame member made of metal or the like and has the plurality of spaces from 13*a* to 13*n*, and in the present embodiment, as shown in FIG. 2, has 8 spaces per one row, that is, a total of 16 spaces 13. In the respective spaces from 13*a* to 13*n* are mounted the connectors from 14*a* to 14*n* connected to the socket boards from 11*a* to 11*n*.

In this manner, the connectors from 14*a* to 14*n* are mounted in the SB frame 12 and the connectors from 14*a* to 14*n* are arranged on the bottom surface sides of the respective socket boards from 11*a* to 11*n* and the connectors from 14*a* to 14*n* are connected to the corresponding socket boards from 11*a* to 11*n* on the SB frame 12.

Then, the plurality of connectors from 14*a* to 14*n* are arranged in the SB frame 12 and hence are fixed on the same plane on the bottom surface sides of the socket boards. Thus, all the connectors are mated with and demated from corresponding connectors 21*a*, 21*b*, 21*c*, 21*d*, . . . , and 21*n* on the motherboard side (refer to FIG. 2).

Here, the socket board 10 in which the plurality of socket boards from 11*a* to 11*n* and connectors from 14*a* to 14*n* are integrally unified by the SB frame 12, as described above, is generally called "DSA (Device Specific Adapter)" The DSA as a unit is manufactured, mated and demated, or changed (replaced) as necessary. Usually, in the semiconductor testing apparatus, the DSAs are mounted on one motherboard in groups of two or in groups of four. Since the socket board 10 is handled by the unified DSA in this manner, for example, in a case where a test is made on the semiconductor components having different package structures and pin structures, the socket boards 10 corresponding to the respective semiconductor components are prepared by the unified DSA and the socket board 10 corresponding to the semiconductor component is mated and demated from the motherboard 20 and is changed.

Here, in the embodiment shown in FIG. 2, the SB frame 12 has 2 rows of frames, each row having 8 frames, that is, a total of 16 frames, and each of the 16 frames is provided with 2 socket boards 11 and 2 connectors 14 corresponding thereto, and hence the socket board 10 is provided with a total of 32 socket boards 11 and a total of 32 connectors 14. It is not intended to specifically limit the number of socket boards 11 (and the number of connectors 14) and the number of spaces of the SB frame 12 to these numbers.

Further, each of the socket boards from 11*a* to 11*n* mounted on the SB frame 12, as shown in FIGS. 2 and 3, is formed in such a shape that the substrate of each socket board is notched at four corners and the frame portion of the SB frame 12 is exposed at the notched portions. Then, in this exposed portion of the SB frame 12, as shown in Fig. 2, a positioning hole 15 is formed into which a positioning pin 22 mounted in a protruding manner on the motherboard 20 is inserted, and hence the socket board 10 is positioned with respect to the motherboard 20 at a predetermined position and fixed there.

Here, while the positioning pins 22 (and positioning holes 15) are formed at two positions on the left and right in a direction of length of the SB frame 12 in this embodiment (refer to FIG. 2), as far as the socket board 10 is positioned at the predetermined position, the positioning pins 22 and the positioning holes 15 can be formed at any positions and the number of them is not limited to a specific number.

Further, in this embodiment, in the exposed portion of the SB frame 12, an engaging hole 16 with which a bulging portion 52 of pulling means 50 of an adapter 30 can freely engage or disengage, as will be described later. This engaging hole 16, as shown in FIG. 2, is a hole formed in a portion where the frame of the SB frame 12 is exposed, that is, in the notched portion of the socket board 11 and, as shown in FIGS. 3(*a*) and 3(*b*), is formed substantially in a shape of a bottle gourd including a large-diameter passing hole 16*a* and a small-diameter sliding hole 16*b* formed continuously to the passing hole 16*a*. The large-diameter passing hole 16*a* of the engaging hole 16 is a substantially perfect circular hole having a diameter large enough for the bulging portion 52 of the pulling means 50 of the adapter 30 to pass through. On the other hand, the small-diameter sliding hole 16*b* is a substantially ellipsoidal hole that is formed continuously to the passing hole 16*a* and has a diameter large enough for the shaft portion 51 of the pulling means 50 of the adapter 30 to pass through and too small for the bulging portion 52 to pass through.

Then, this engaging portion 16 is formed in the exposed portion of the SB frame 12, that is, in the frame portion exposed from the notched portion of the socket board 11 and in this embodiment, as shown in FIG. 2, four engaging portions 16 are formed at four positions at equal intervals in the direction of length of the SB frame 12.

By forming the plurality of engaging portions 16 at the plurality of portions at equal intervals, as will be described later, a pulling force is equally applied to the SB frame 12 by the pulling means 50 of the adapter 30 moved up and down by the adapter lifting and lowering unit 100 demating the plurality of connectors from 14*a* to 14*n* of the socket boards from 11*a* to 11*n* from the connectors from 21*a* to 21*n* of the motherboard 20 at the same time. Here, while the engaging holes 16 are formed at four positions in this embodiment, needless to say, they are increased or decreased in number according to the number of pulling means of the adapter 30 and the positions where they are formed.

Further, the exposed portions of the SB frame 12 are allotted also to portions pressed by the pressing means 40 of the adapter 30. As described above, notched portions are formed at four corners of each of the socket boards from 11*a* to 11*n* and the frame portions of the SB frame 12 are exposed from the notched portions. Thus, in this embodiment, the pressing means 40 of the adapter 30 is made to abut against the exposed portions of the SB frame 12 and the SB frame 12 is pressed to urge and press the socket board 10 to the motherboard 20.

Here, of the exposed portions of the SB frame 12, portions where the foregoing positioning holes 15 and engaging holes 16 are not formed are allotted to the portions pressed by the pressing means 40 of the adapter 30 (refer to FIGS. 2 and 3). To be specific, first, in correspondence to fixed pressing portions 41 which will be described later, other four positions in the exposed region formed along the direction of length of center of the SB frame 12 where the positioning holes 15 and the engaging hole 16 are formed are allotted to portions to be pressed. Further, in correspondence to resilient pressing portions 42 which will be described later, 4 positions for each side, that is, a total of 8 positions in the exposed region along both the outside edges in the direction of length of the SB frame 12 are also allotted to portions to be pressed.

By forming the portions pressed by the pressing means 40 of the adapter 30 on the SB frame 12 at the plurality of positions at predetermined intervals, as will be described later, the pressing force applied by the pressing means 40 of the adapter 30 moved up and down by the adapter lifting and lowering unit 100 can be uniformly applied to the SB frame 12, so that it is possible to mate the connectors from 14*a* to 14*n* of the plurality of socket boards from 11*a* to 11*n* to the connectors from 21*a* to 21*n* of the motherboard 20 at the same time. Here, needless to say, also the portions pressed by the pressing means 40, as is the case with the foregoing engaging holes 16, can be increased or decreased in the number according to the number of pressing means 40 of the adapter 30 and the positions where they are formed.

The motherboard 20, as shown in FIG. 1, is a substrate mounted on the main body side of the semiconductor testing apparatus and, as described above, is provided with the plurality of connectors (motherboard connectors) ranging from 21*a* to 21*n* corresponding to the unified socket board 10 (refer to FIG. 2). Since the socket board 10 is connected to the motherboard 20 via the connectors, a predetermined electric signal necessary for test is inputted to or outputted from the socket board 10 via the motherboard 20 to conduct the test on the semiconductor components on the respective socket boards from 11*a* to 11*n*.

In this respect, a portion shown as the motherboard 20 in this embodiment generally includes not only the motherboard mounted on a test head of the semiconductor testing apparatus but also an SPC, a metal plate, a performance board and the like. Thus, the word of "the motherboard" used in this embodiment means a mating substrate or a mating device which the unified socket board (DSA) 10 can be freely mated and demated from.

Further, although detailed description will be omitted, not only the foregoing socket board 10 and motherboard 20 but also the construction and function of the semiconductor testing apparatus of this embodiment are the same as those of the existing semiconductor testing apparatus.

[Adapter]

Figure 4:
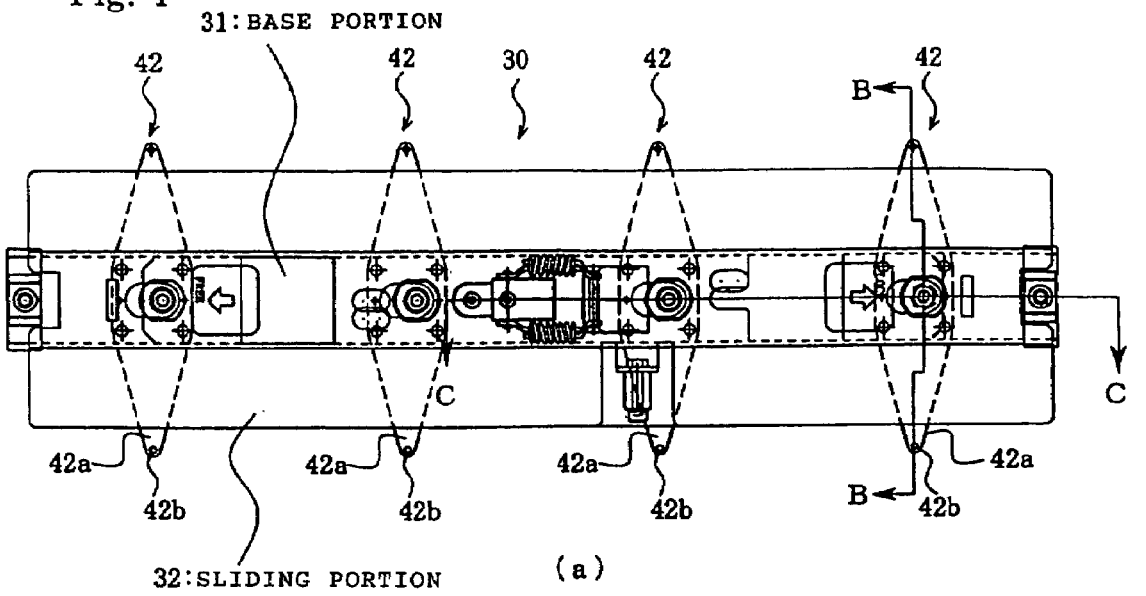
FIGS. 4(*a*)-4(*c*) are illustrations showing an adapter of the jig for mating and demating connectors in accordance with one embodiment of the present invention, where FIG. 4(*a*) is a plan view, and FIG. 4(*b*) is a cross-sectional view taken along line B-B in FIG. 4(*a*), and FIG. 4(*c*) is a cross-sectional view taken along line C-C in FIG. 4(*a*).
Figure 4:
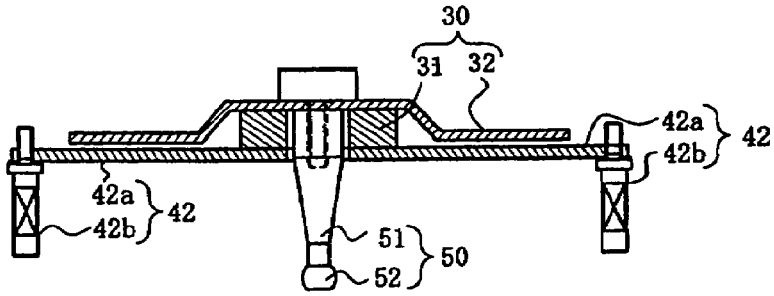
Figure 4:
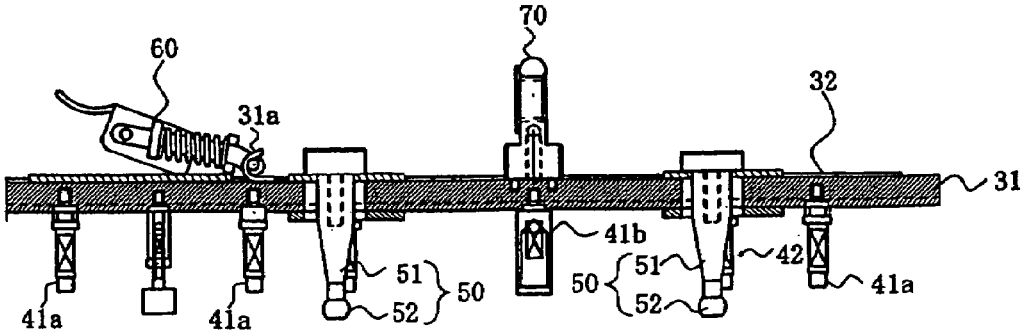

Next, with reference to FIGS. 4(*a*)-4(*c*), the adapter 30 of the jig for mating and demating the connectors in accordance with this embodiment will be described. FIGS. 4(*a*)-4(*c*) are illustrations showing the adapter 30 of the jig for mating and demating connectors in accordance with this embodiment, where FIG. 4(*a*) is a plan view, FIG. 4(*b*) is a cross-sectional view taken on a line B-B in FIG. 4(*a*), and similarly, FIG. 4(*c*) is a cross-sectional view taken on a line C-C in FIG. 4(*a*).

The adapter 30 shown in these drawings is a plate-shaped member opposed to a surface different from a surface on which the connectors of the socket board 10 are arranged, that is, a surface on which the semiconductor components are mounted. (the upper surface of the socket board in FIG. 1), and is provided by the DSA constructing the socket board 10. Then, the adapter 30 is moved forward and backward (up and down) by the adapter lifting and lowering unit 100 along the direction in which the connectors of the socket board 10 are mated and demated from the motherboard 20 thereby to mate and demate the connectors (socket board connectors) of the socket board 10 with and from the connectors (motherboard connectors) of the motherboard 20.

The adapter 30 as shown in FIGS. 4(*a*)-4(*c*), has a base portion 31 and a sliding portion 32. The base portion 31 is formed of a plate member having an outside shape substantially similar to an outside shape of the socket board 10 (refer to FIGS. 5 and 6) and is arranged and fixed with a predetermined gap between itself and the surface of the socket board 10 on which the semiconductor components are mounted. Then, the base portion 31 is provided with the pressing means 40 for pressing the socket board 10 (fixed pressing portion 41 and resilient pressing portion 42) (see FIGS. 4 to 6)

The sliding portion 32 is a plate-shaped member that can freely slide with respect to the base portion 31. In this embodiment, as shown in FIGS. 4(*a*)-4(*c*), the sliding portion 32 is arranged on the upper surface side of the base portion 31 and is formed in a shape of a thin plate covering the socket board 10 and is mounted in such a manner as to freely slide in the longitudinal direction of the base portion 31. Then, the sliding portion 32 is provided with the pulling means 50 (see FIGS. 4 to 6).

The pressing means 40 is a shaft-shaped member mounted in a protruding manner on the base portion 31 of the adapter 30 and is protruded toward the socket board 10. By moving forward (down) the adapter 30, the pressing means 40 is made to contact a surface different from a surface on which the connectors of the SB frame 12 of the socket board 10 are arranged, that is, a surface on which the semiconductor components are mounted thereby pressing the socket board 10 to the motherboard 20.

Then, the pressing means 40 in accordance with this embodiment has two kinds of pressing means of the fixed pressing portion 41 and the resilient pressing portion 42.

The fixed pressing portion 41, as shown in FIG. 4(*c*), is a pillar-shaped member mounted on the bottom surface of the base portion 31 of the adapter 30 in such a manner as to protrude toward the substrate surface of the socket board 10 and contact the exposed portion of the SB frame 12 by lifting and lowering the adapter 30.

In this embodiment, as shown in FIG. 4(*c*), the fixed pressing portion 41 has a pillar-shaped portion 41*a* and a cylindrical portion 41*b*. The pillar-shaped portion 41*a* is a pillar-shaped member mounted in a protruding manner on the base portion 31 along the longitudinal direction of center of the base portion 31 at the center thereof in such a way as to contact the exposed portion in the longitudinal direction at the center of the SB frame 12 and there are provided four pillar-shaped portions 41*a* (refer to FIGS. 5 and 6). On the other hand, the cylindrical portion 41*b* is a hollow cylindrical member contacting the periphery of the positioning pin 22 (refer to FIG. 2) of the motherboard 20, which protrudes from the positioning hole 15 of the SB frame 12, and the cylindrical portions 41*b* are mounted at two positions corresponding to two positioning pins 22. By providing the cylindrical portions 41*b* like this, it is possible to press also the portions near the peripheries of the positioning holes 15 of the SB frame 12 and hence to urge and press the SB frame 12 further uniformly by the fixed pressing portion 41 without causing interference with the projecting positioning pin 22.

Here, the length (protruding length) of the pressing means 40 (fixed pressing portion 41 and resilient pressing portion 42) can be set at a suitable length according to the size of the socket board 10 to be mated and demated by the use of the adapter 30, the mating forces of the connectors, and the like. The fixed pressing portion 41 (pillar-shaped member 41*a* and cylindrical member 41*b*) is formed slightly shorter than the pillar-shaped member 42*b* of the resilient pressing means 42, which will be described later. In this manner, in a case where the adapter 30 is moved forward (down) to the SB frame 12, the pillar-shaped member 42*b* of the resilient pressing portion 42 contacts the SB frame 12 earlier than the pillar-shaped member of the fixed pressing portion 41.

The resilient pressing portion 42, as shown in FIGS. 4(*a*) and 4(*b*), has a plate-shaped portion 42*a* extending from the base portion 31 of the adapter 30 in parallel to the substrate surface of the socket board 10 and a pillar-shaped portion 42*b* mounted on tip portion of the plate portion 42*a* in a manner protruding toward the substrate surface of the socket board 10.

The plate-shaped portion 42*a* is made of a elastic metal plate or the like and is fixed to the base portion 31 of the adapter 30 and extends in a shape of a wing in the direction of width of the adapter 30 and the pillar-shaped portions 42*b* are fixed to the respective tip portions of the plate-shaped portion 42*a*. According to the resilient pressing portion 42 including the plate-shaped portion 42*a* and the pillar-shaped portions 42*b*, the plate-shaped portion 42*a* is resiliently deflected and the pillar-shaped portions 42*b* press the SB frame 12 resiliently when the pillar-shaped portions 42*b* abuts to the SB frame 12 of the socket board 10.

Then, since the resilient pressing portion 42 resiliently presses and urges the SB frame 12, the socket board 10 is smoothly urged and pressed to the motherboard 20 thereby to mate the connectors further smoothly and hence surely mate the connectors while absorbing shock applied to the socket board 10 and the motherboard 20 by means of resilience.

Here, each of the pillar-shaped portions 42*b* mounted in the protruding manner on the tip portions of the plate-shaped portion 42*a* is slightly longer than the pillar-member of the foregoing fixed pressing portion 41. Then, in a case where the adapter 30 is moved down toward the SB frame 12, the pillar-shaped portions 42*b* of the resilient pressing portion 42 contact the SB frame 12 earlier than the pillar-member of the fixed pressing portion 41, whereby the plate-shaped portion 42*a* is deflected so that the pillar-shaped portions 42*b* resiliently press the SB frame 12.

In this respect, in the resilient pressing portion 42 of this embodiment, as shown in FIG. 4(*a*), four plate-shaped portions 42*a* protruding toward both ends of the base portion 31 in a shape of a wing 42*a* are mounted along the direction of length of the adapter 30 at equal intervals and the pillar-shaped portions42*b* are mounted on both the tip portions of the respective plate-shaped portions 42*a* and hence a total of 8 pillar-shaped portions 42*b* press the exposed portions along both outside edges in the direction of length of the SB frame 12.

As described above, in this embodiment, the plurality of pressing means 40 each including the fixed pressing portion 41 and the resilient pressing portion 42 are formed to the adapter 30 at a plurality of positions at predetermined intervals. Thus, by moving down the adapter 30 by the adapter lifting and lowering unit 100, it is possible to make the plurality of pressing portions 41, 42 abut against the SB frame 12 uniformly and hence to apply a pressing force to the whole of the socket board 10. The pressing means 40 each including the fixed pressing portion 41 and the resilient pressing portion 42 can be suitably increased or decreased in number according to the size of connector mated by means of the adapter 30, the number of pins, the degree of ease of mating, and the like.

The pulling means 50 is shaft-shaped means mounted in a protruding manner on the sliding portion 32 of the adapter 30 and is engaged with the engaging hole 16 formed in the SB frame 12 to pull the socket board 10 in the direction separating from the motherboard when the adapter 30 is moved backward. The pulling means 50 has the shaft portion 51 mounted in a protruding manner slidably with respect to the adapter 30 and the bulging portion 52 formed at the tip of the shaft portion 51 and having a larger diameter than the shaft portion 51.

The shaft portion 51 is formed of a shaft-shaped means having a diameter smaller than that of the passing hole 16*a* and the sliding hole 16*b* of the engaging hole 16 of the SB frame 12 and has the bulging portion 52 formed at the tip. Here, the shaft portion 51, as shown in FIG. 4(*b*), is mounted in a protruding manner and fixed to the sliding portion 32 of the adapter 30 and protrudes through the base portion 31 toward the socket board 10. Then, in the base portion 31 through which the shaft portion 51 passes, there is formed a hole elongated along the direction in which the sliding portion 32 slides. In this manner, the shaft portion 51 can slide with the sliding portion 32 in the longitudinal direction of the adapter 30 within a range of the elongated hole of the base portion 31 it passes through. Since the shaft portion 51 of the pulling means 50 is fixed to the sliding portion 32, in this embodiment, also by providing a plurality of pulling means 50, by sliding the sliding portion 32, it is possible to slide all the pulling means 50 by one operation and hence to easily and surely engaging the bulging portion 52 with the engaging hole 16 of the SB frame 12.

Figure 6:
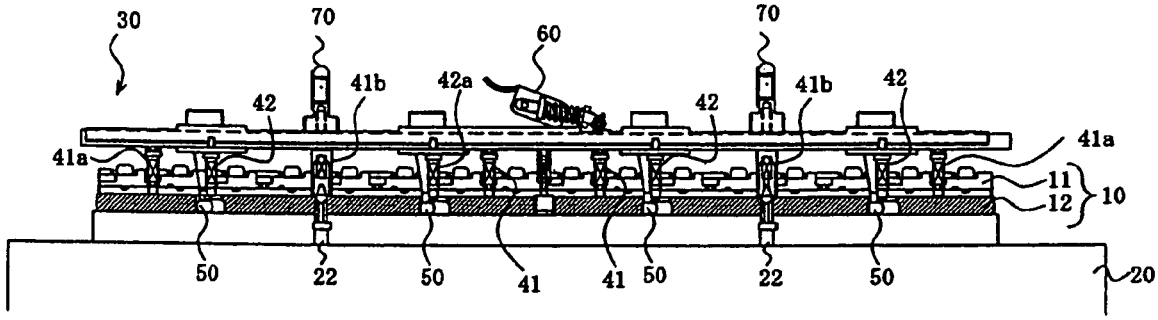
FIGS. 6(*a*) and 6(*b*) show an operation of mating and demating the socket board with and from the motherboard in the semiconductor testing apparatus using the jig for mating and demating connectors in accordance with one embodiment of the present invention where FIG. 6(*a*) is a schematic front view showing a state where the socket board is mounted with the adapter and FIG. 6(*b*) is an enlarged partial cross-sectional side view showing the same state.
Figure 6:
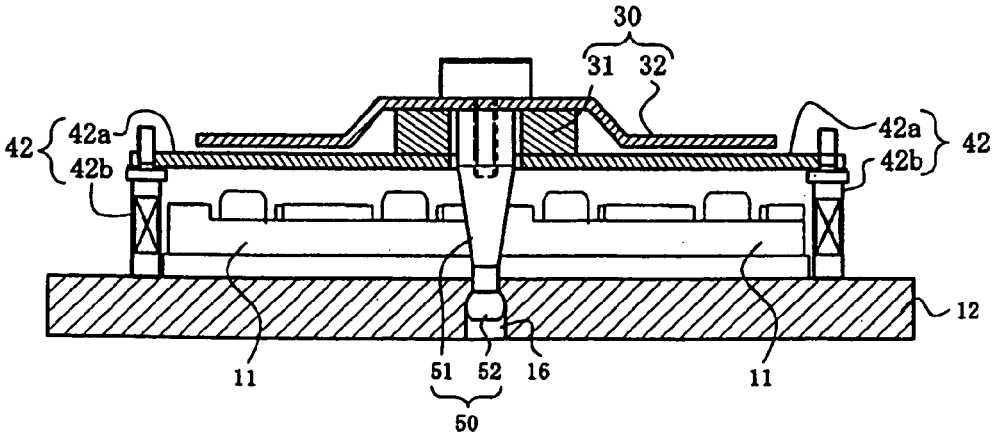

Further, the length (protrusion height) of the shaft portion 51 is set in such a manner that the bulging portion 52 passes the passing hole 16*a* in a state where the foregoing pressing means 40 (fixed pressing portion 41 and resilient pressing portion 42) the SB frame 12 (refer to FIG. 6). The outside diameter of the bulging portion 52 allows the bulging portion formed at the tip of the shaft portion 51 to pass through the passing hole 16*a* of the engaging hole 16 of the SB frame 12 while preventing it from passing through the sliding hole 16*b*. Here, when the pressing means 40 contacts the SB frame 12, the bulging portion 52 is set such that it passes through the passing hole 16*a* of the engaging hole 16 and is positioned in the hole (refer to FIG. 6). Thus, when the adapter 30 is moved down toward the socket board 10, the bulging portion 52 that passes through the passing hole 16*a* of the engaging hole 16 of the SB frame 12 and is positioned in the passing hole 16*a* is moved to the sliding hole 16*b* by sliding the shaft portion 51, whereby the bulging portion 52 is engaged with the sliding hole 16*b* in such a manner that it can not drop and hence the pulling means 50 is engaged with the SB frame 12 in such a way that it can not drop. Therefore, when the adapter 30 is moved backward (up) by the adapter lifting and lowering unit 100 in this state, the socket board 10 is pulled by the pulling means 50 in a direction in which it is separated from the motherboard 20.

Here, the bulging portion 52 in accordance with this embodiment, as shown in FIGS. 4(*b*) and 4(*c*), is formed in a substantially spherical outer shape. Since the bulging portion 52 is formed in a spherical shape, even if the shaft of the pulling means 50 is fixed to the adapter side at any angle, the bulging portion 52 bulging in the spherical shape surely engages with the edge portion of the sliding hole 16*b* of the engaging hole 16 to eliminate the need for adjusting the direction in which the pulling means 50 is mounted on the adapter 30, which results in facilitating assembling the adapter 30 and mounting or dismounting the adapter 30 on or from the socket board 10 and surely pulling the socket board 10.

Then, the pulling means 50 each having the shaft portion 51 and the bulging portion 52 described above are formed on the sliding portion 31 at four positions at equal intervals in the direction of length of adapter 30. By forming the pulling means 50 at the plurality of positions at equal intervals in this manner, when the adapter 30 is lifted and lowered by the adapter lifting and lowering unit 100, it is possible to uniformly apply a pulling force to the SB frame 12 by the pulling means 50 and hence to demate and separate the connectors 14 of the socket board 11 mated with the connectors 21 of the motherboard 20 integrally at the same time. Here, while the pulling means 50 are formed at four positions in the direction of length of the adapter 30 in this embodiment, needless to say, the number of the pulling means 50 and the positions where they are mounted can be increased or decreased and changed according to the size, the number of pins, the connecting force and the like of the connectors to be demated and separated.

Then, in this embodiment having the pulling means 50 on the sliding portion 32 of the adapter 30 in this manner, the adapter 30 is provided with fixing means 60 for fixing the sliding portion 32 to the base portion 31 such that it can not slide with respect to the base portion 31. By providing the fixing means 60 for fixing the sliding portion 32 to the base portion 31 such that it can not move with respect to the base portion 31, after the bulging portion 52 of the pulling means 50 is slid and engaged with the SB frame 12 of the socket board 10, by fixing the sliding portion 32 to the base portion 31, the pulling means 50 can be fixed such that it can not slide. This can surely prevent the bulging portion 52 from involuntarily dropping from the engaging hole 16 of the SB frame 12 and hence from being shifted in position.

Here, in the adapter 30 in this embodiment, a latch for fixing the sliding portion 32 to the base portion 31 is used as the fixing means 60. The latch, as shown in FIG. 4(*c*), is a latch provided with a coil spring arranged on the upper surface side of the adapter 30 and fixed to the sliding portion 32 and has a buckle structure in which one end side of the latch is hooked and fixed on a hook 31*a* fixed to the base 31. Since the latch is fixed in this manner, the sliding portion 32 is pulled to the hook side of the base portion 31 and fixed there by the pulling force of the coil spring of the latch. Then, the pulling means 50 mounted on the sliding portion 32, as will be described later, is engaged and fixed in a state where the bulging portion 52 is urged to the sliding hole 16*b* of the engaging hole 16 of the SB frame 12 (refer to FIG. 7). Here, the fixing means 60 for fixing the sliding portion 32 to the base portion 31 in such a manner that it can not slide is not limited to the latch described in this embodiment but other fixing means and fixing structures can be used such as a stopper for regulating the movement of the sliding portion 32, screws or bolts for fixing, or the like.

Further, the adapter 30 described above is mounted with cylinder insertion portions 70 on the upper surface. The cylinder insertion portions 70, as shown in FIG. 1, are mounted at two positions corresponding to the cylindrical portions 41*b* on the upper surface of the adapter 30 and in this embodiment, each of them is formed in an annular shape (in a shape of a ring) into which the protrusion 101*a* of a horizontal cylinder 101 of the adapter lifting and lowering unit 100, which will be described later, can be freely inserted into or extracted from. Then, by inserting and fixing the protrusion 101*a* of the horizontal cylinder 101 into the cylinder insertion portion 70, the adapter 30 is held and fixed by the adapter lifting and lowering unit 100 such that it can not drop and when a vertical cylinder 102 which will be described later is driven, is moved up and down in the vertical direction.

Incidentally, the adapter 30 in accordance with this embodiment is provided with not only the foregoing respective constituent portions but also, as shown in FIG. 1, a pillar-shaped member protruding from below the fixing means 60 to the socket board 10. Although the pillar-shaped member will not be described in detail because it is not a main part of the adapter 30 in accordance with this embodiment, when the pillar-shaped member is inserted into a hole made in the central portion of the SB frame 12 of the socket board 10, a latch structure of a metal plate on the motherboard 20 side is pressed to fix the metal plate to the SB frame 12.

[Adapter Lifting and Lowering Unit]

Next, the outline of the adapter lifting and lowering unit 100 in accordance with this embodiment will be described with reference to FIG. 1. The adapter lifting and lowering unit 100, as shown in FIG. 1, is a driving unit arranged above the adapter 30 and has a horizontal cylinder 101, a vertical cylinder 102, and a shock absorber 103.

The horizontal cylinder 101 is a cylinder for driving the protrusion 101*a* in a horizontal direction (in a left-right direction in the drawing) and the protrusion 101*a* driven by the horizontal cylinder 101 is freely inserted into or extracted from the cylinder insertion portion 70 provided on the side of the upper surface of the adapter 30. When the protrusion 101*a* is inserted into and fixed by the cylinder insertion portion 70, the adapter 30 is held and fixed by the adapter lifting and lowering unit 100.

The vertical cylinder 102 is a cylinder for driving the horizontal cylinder 101 in a vertical direction (in an up-down direction in the drawing). When the vertical cylinder 102 is driven, the adapter 30 held and fixed by the protrusion 101*a* of the horizontal cylinder 101 is lifted and lowered in the vertical direction. This freely moves the adapter 30 close to and away from the socket board 10 and the motherboard 20 to mate and demate the connectors 14 of the socket board 10 with and from the connectors 21 of the motherboard 20.

The shock absorber 103 is a cylinder protruding toward the adapter 30 held by the horizontal cylinder 101 and is provided at the tip with an elastic member such as rubber resiliently abutting against the upper surface of the adapter 30. Since the shock absorber 103 resiliently abuts against the adapter 30, it absorbs shock produced at the instant when the connectors of the socket board 10 are demated from the connectors of the motherboard 20.

Incidentally, the adapter lifting and lowering unit 100 constructed in the manner described above is one example of driving means for moving the adapter 30 in accordance with this embodiment close to and away from the socket board 10, and it is not intended to specifically limit the present invention to the adapter lifting and lowering unit 100 described in this embodiment.

[Operation of Mating and Demating Connectors]

An operation of mating and demating the connectors of the socket board 10 with and from the connectors of the motherboard 20 by the use of the jig for mating and demating connectors in accordance with this embodiment constructed in the above manner will be described with reference to operation illustrations shown in from FIGS. 5 to 8.

Figure 5:
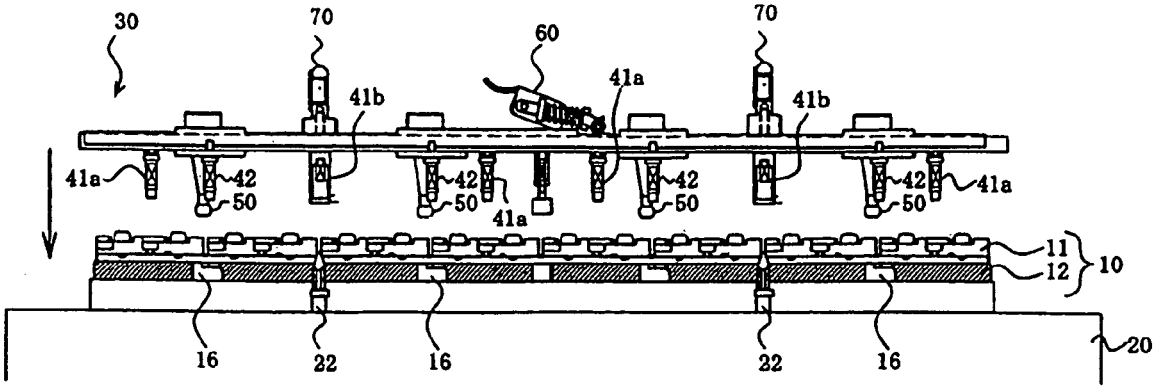
FIG. 5 is a schematic front view showing an operation of mating and demating a socket board with and from a motherboard in the semiconductor testing apparatus using the jig for mating and demating connectors in accordance with one embodiment of the present invention and showing a state where the socket board is not mounted with the adapter.

First, as shown in FIG. 5, in a case where the connectors of the socket board 10 mated with the connectors of the motherboard 20 are demated, the adapter 30 is arranged above the socket board 10 (in a state shown in FIG. 5) and then is lowered and placed on the upper surface of the socket board 10. At this time, although the adapter 30 can be placed on the socket board 10 by hand, it can be also automatically placed by the use of the adapter lifting and lowering unit 100. Further, in this state, the fixing means 60 is set in an unfixed state.

Figure 7:
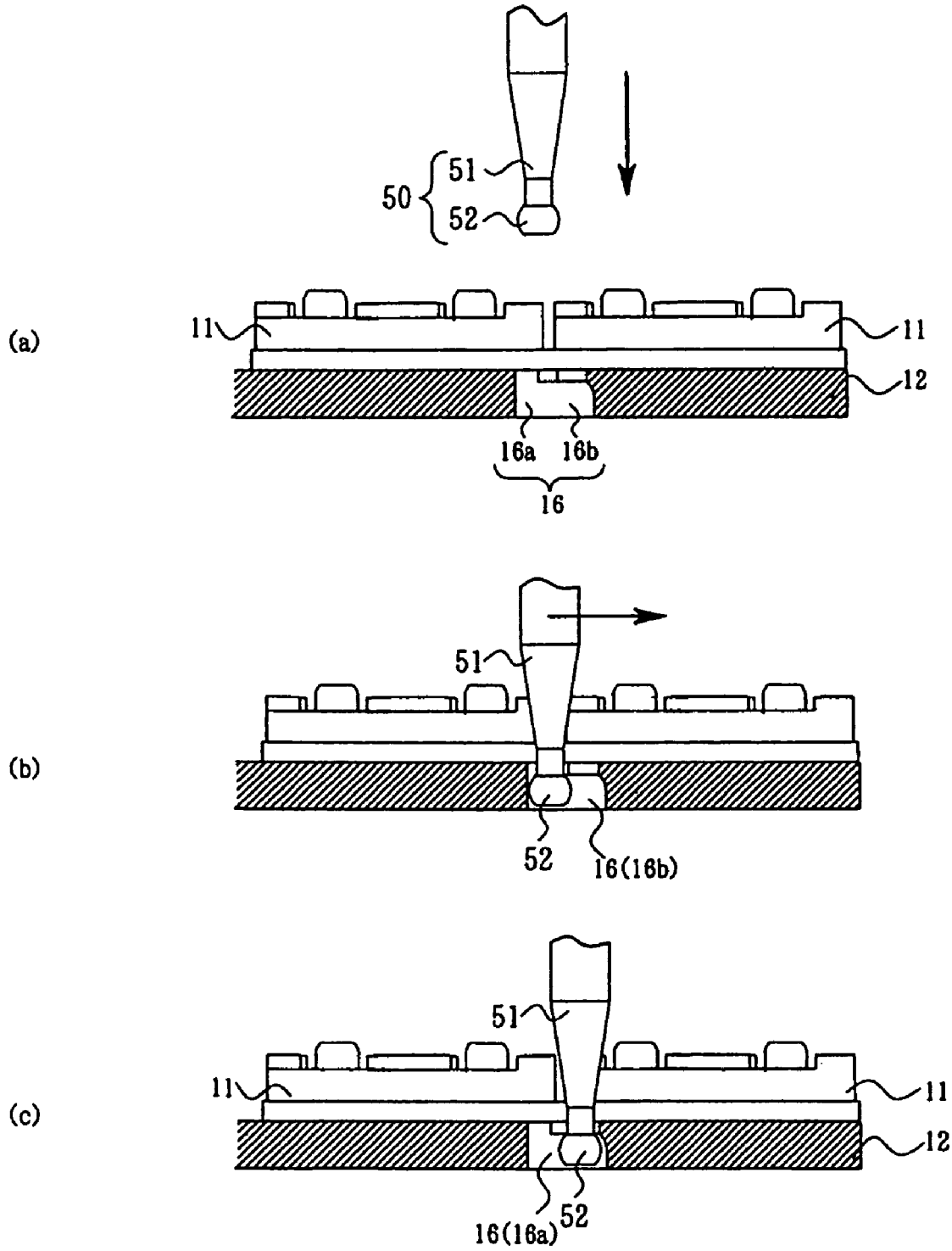
FIGS. 7(*a*)-7(*c*) are enlarged cross-sectional views of the main portion of pulling means and engaging holes, which shows variations in the operation of mating and demating the socket board with and from the motherboard of the semiconductor testing apparatus using the jig for mating and demating connectors in accordance with one embodiment of the present invention.

When the adapter 30 is placed on the socket board 10, as shown in FIGS. 6 and 7(*a*), 7(*b*), the bulging portions 52 of the pulling means 50 are passed through and positioned in the passing holes 16*a* of the engaging holes 16 of the SB frame 12 and the pressing means 40 are made to abut against the SB frame 12. In this state, the base portion 31 of the adapter 30 is fixed while it is being positioned at the predetermined position of the SB frame 12 (refer to FIG. 6).

In this respect, when the pressing means 40 are made to abut against the SB frame 12, since the resilient pressing portions 42 are a little longer than the fixed pressing portions 41, the resilient pressing portions 42 are made to abut against the SB frame 12 earlier than the fixed pressing portions 41 and the fixed pressing portions 41 are made to abut against the SB frame 12.

Then, when the sliding portion 32 of the adapter 30 is slid in the direction of length (in the right direction in FIGS. 6(*b*) and 7(*c*)), the pulling means 50 mounted in the protruding manner on the sliding portion 32 are slid along with the sliding portion 32 (refer to FIG. 7(*c*)), whereby the bulging portions 52 in the engaging holes 16 are moved from the passing holes 16*a* to the sliding holes 16*b*. This engages the bulging portions 52 with the sliding holes 16*b* such that they can not drop and hence engages the pulling means 50 with the SB frame 12 such that they can not drop. Here, although the sliding portion 32 of the adapter 30 can be slid by hand, it can be also automatically slid by the use of the driving means such as the adapter lifting and lowering unit 100.

Then, in this state, the fixing means 60 formed by the latch is set in a fixed state to fix the sliding portion 32 to the base portion 31 such that the sliding portion 32 can not move with respect to the base portion 31. In this manner, the sliding portion 32 is fixed to the base portion 31 and hence the pulling means 50 are fixed in a state that they can not move thereby to prevent the bulging portions 52 from being dropped from or shifted in positions in the engaging holes 16 (refer to FIG. 7(*c*)). In this state, the adapter 30 is retracted (lifted up), that is, in the direction in which the socket board 10 is separated from the motherboard 20.

This lifting-up of the adapter 30 is performed by the adapter lifting and lowering unit 100 shown in FIG. 1. To be more specific, first, the vertical cylinders 102 are driven to lower the horizontal cylinders 101 to align them to the cylinder insertion portions 70 on the upper surface of the adapter 30. Then, the horizontal cylinders 101 are driven to move the protrusions 101*a* in the horizontal direction (in the left direction in the drawing) thereby to insert them into the cylinder insertion portions 70 on the upper surface of the adapter 30 and to fix them there. In this state, the adapter 30 is held and fixed by the adapter lifting and lowering unit 100.

Then, the vertical cylinders 102 are driven to move or lift up the horizontal cylinders 101 in the vertical direction (in the up-down direction in the drawing). Since the vertical cylinders 102 are lifted up, the adapter 30 held and fixed by the protrusions 101*a* of the horizontal cylinders 101 is also lifted up in the vertical direction. This pulls up the socket board 10 with which the adapter 30 engages, as shown in FIG. 8, which in turn demates the connectors 14 of the socket board 10 from the connectors 21 of the motherboard 20.

Next, in a case where the connectors of the socket board 10 which are not mated with the connectors of the motherboard 20 are mated with them, the operation is the reverse of the above operation of demating the connectors.

Figure 8:
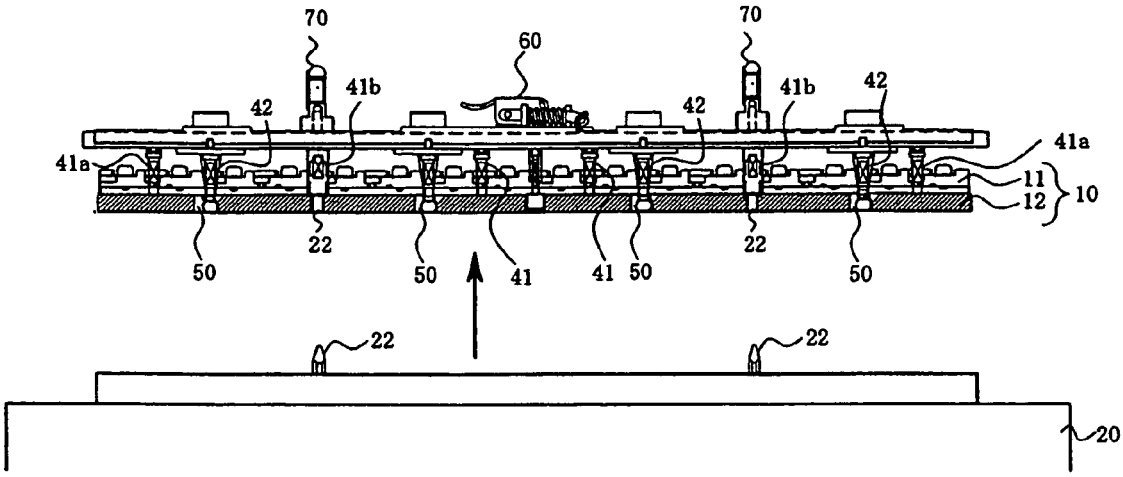
FIG. 8 is a schematic front view showing the operation of mating and demating the socket board with and from the motherboard of the semiconductor testing apparatus using the jig for mating and demating connectors in accordance with one embodiment of the present invention and showing a state where the socket board is demated from the motherboard.

First, as shown in FIG. 8, in a state the adapter 30 is engaged with and fixed to the socket board 10, the socket board 10 is placed on the motherboard 20 while it is being positioned by the use of the adapter lifting and lowering unit 100. In this state, the vertical cylinders 102 of the adapter lifting and lowering unit 100 are driven to press the socket board 10 to the motherboard 20.

At this time, since the resilient pressing portions 42 each of which is a little longer than the fixed pressing portion 41 abut against the SB frame 12 of the socket board 10, when the vertical cylinders 102 are driven, first, the plate portions 42*a* of the resilient pressing portions 42 press the SB frame 12 with the plate portions 42*a* deflected and then the sunk fixed pressing portions 41 abut against the SB frame 12 to press the SB frame 12. In this manner, the SB frame 12 is pressed and urged by both the resilient pressing portions 42 and the fixed pressed portions 41.

The connectors 14 of the socket board 10 are mated with the connectors 21 of the motherboard 20 by this pressing force (refer to FIG. 6).

Thereafter, first, the fixing means 60 for fixing the sliding portion 32 to the base portion 31 of the adapter 30 is unfixed to return the sliding portion 32 to a state in which the sliding portion 32 can slide with respect to the base portion 31. This brings the pulling means 50 mounted on the sliding portion 32 into a sliding state, then the bulging portions 52 of the pulling means 50 are moved by the engaging holes 16 to disengage the pulling means 50 in the order shown in FIGS. 7(*c*), 7(*b*), and 7(*a*).

When the pulling means 50 are disengaged, the adapter 30 can be removed from the socket board 10 and hence the adapter 30 is removed from the socket board 10 by hand or by the use of the adapter lifting and lowering unit 100. This is the end of mating the connectors of the socket board 10 with the connectors of the motherboard 20.

As described above, according to the jig for mating and demating connectors in accordance with this embodiment, by moving forward or backward the adapter 30 that has pressing means 40 abutting against the substrate (SB frame 12) of the socket board 10 mounted with the plurality of connectors from 14*a* to 14*n* and the pulling means 50 engaging with the engaging holes 16 formed in the substrate (SB frame 12) of the socket board 10 along the direction in which the connectors are mated by the use of means such as the adapter lifting and lowering unit 100 and the like, the socket board 10 can be moved forward and backward to the motherboard 20 to be mated. This forward or backward movement of the adapter 30 mates and demates the plurality of connectors from 14*a* to 14*n* mounted on the socket board 10 with and from the connectors from 21*a* to 21*n* of the motherboard 20. Thus, in the semiconductor testing apparatus to be provided with the plurality of connectors, all the connectors can be mated or demated by one operation. Therefore, according to this embodiment, only by lifting or lowering the adapter 30 having a simple construction, it is possible to easily and surely mate and demate all the connectors of the socket board 10 of the substrate with and from all the connectors of the motherboard 10 to be mated.

In particular, in this embodiment, the substrate and its mate of which the connectors are mated and demated by the use of the adapter 30 are the unified socket board 10 and the motherboard 20 in the semiconductor testing apparatus. Thus, in the semiconductor testing apparatus capable of responding to a test on various kinds of semiconductor components by singly changing only the socket board 10, it is possible to automatically conduct an operation of mating and demating the socket board 10 with and from the motherboard 20 by the use of the adapter 30 and the adapter lifting and lowering unit 100.

Further, since the adapter 30 in accordance with this embodiment is mounted on the socket board 10, it is not necessary to provide the motherboard 20 with a mechanism for mating and demating the socket board 10 and hence the motherboard 20 is not made complex.

Still further, since the adapter 30 can mate and demate the socket board 10 by the DSA, it is possible to mate and demate many socket boards 10 by the use of one adapter 30 and hence to improve performance or efficiency in mounting the socket board 10 on motherboard 20.

As described above, according to the present invention, it is possible to reduce a load on the operation of mating and demating the connectors in the semiconductor testing apparatus and hence to make tests on the semiconductor components with a high degree of efficiency.

Up to this point, the jig for mating and demating connectors of the present invention has been described by showing the preferred embodiment. However, the jig for mating and demating connectors of the present invention is not limited to the above embodiment but can be variously modified within the scope of the present invention.

For example, while the jig for mating and demating connectors of the present invention has been described by taking the operation of mating and demating the connectors of the socket board with and from the connectors of the motherboard as an example, the object for which the jig of the present invention is used is not limited to the socket board and the motherboard, and the connectors to be mated and demated by the jig of the present invention are not specifically limited in number and mating structure.

That is, if one or more connectors mounted on a substrate or an apparatus are mated with and demated from the connectors mounted on the substrate or the apparatus of the mate corresponding thereto, the jig for mating and demating connectors of the present invention can be applied to any connectors mounted on any substrate or any apparatus.

In the semiconductor testing apparatus, in addition to the socket board on which the semiconductor components to be tested are placed, for example, a self-diagnostic board is used which is mated with and demated from the motherboard via connectors for the purpose of testing the semiconductor testing apparatus itself. The jig for mating and demating connectors of the present invention can be used also for mating and demating the self-diagnostic board with and from the motherboard. Further, the jig for mating and demating connectors of the present invention is not affected by the construction or the number of the connectors mounted on the boards.

Further, while the jig (adapter) used for mating and demating the connectors is moved up and down in the vertical direction with respect to the substrate (socket board) in the foregoing embodiment, the direction in which the jig is moved with respect to the substrate is not limited to the vertical direction. For example, in a case where the substrates to be mated are vertically mounted, the direction in which the connectors are mated and demated is the horizontal direction and hence the jig of the present invention is moved forward and backward in the horizontal direction.

That is, the jig of the present invention is not limited in the direction of movement as far as it is moved back and forth along the direction in which the connectors to be mated and demated are mated and demated, and can be moved back and forth in the arbitrary direction according to the direction in which the connectors are mated and demated such as the vertical direction, the horizontal direction and a slanting direction. The direction in which the jig is moved back and forth does not affect the effect produced by the present invention.

Further, while the air cylinders mounted on the lifting and lowering unit are used as means for moving back and forth the adapter in the foregoing embodiment, the means for moving back and forth the adapter is not limited to the air cylinder. Any apparatus or jig, for example, a lever can be used as the means for moving back and forth the adapter as far as it can move back and forth the adapter in a desired direction.

Still further, while the pressing means for pressing the socket board and the pulling means for pulling the socket board are mounted in the protruding manner on the adapter in the foregoing embodiment, these pressing means or pulling means can be mounted on the SB frame of the socket board that is the substrate and can mate and demate the connectors of the substrate with and from the connectors of the motherboard by the pressing force of the pressing means and the pulling force of the pulling means. That is, the pressing means and the pulling means can be mounted on the substrate or the adapter of the present invention. Further, the jig can omit the pressing means (or the pulling means) and have only the pulling means (or the pressing means).

INDUSTRIAL APPLICABILITY

As described above, the jig for mating and demating connectors of the present invention has the adapter abutting against and engaging with the substrate provided with the connectors and by moving the adapter forward and backward in the direction in which the connectors are mated and demated, can move the substrate forward or backward in the direction in which the connectors are mated and demated thereby to mate and demate the connectors of the substrate with and from the connectors of the mate. This makes it possible to easily and surely mate and demate all the connectors at the same time even if many connectors are provided. Thus, the jig for mating and demating connectors of the present invention is particularly suitable for mating and demating the connectors of the socket board or the self-diagnostic board that can be mated with and demated from the motherboard of the test apparatus of the semiconductor components.

The invention claimed is:

1. A system for mating and demating a plurality of socket board connectors mounted on a common surface of a socket board with respect to a plurality of corresponding motherboard connectors mounted on a motherboard where the socket board and the motherboard are provided in a semiconductor testing apparatus, the mating and demating system comprising:

an adapter that is arranged opposite to a reverse side of the surface of the socket board on which the socket board connectors are mounted and is moved forward and backward in a direction to mate and demate the socket board connectors; and pulling means that is mounted in a protruding manner on the adapter or the socket board and engages with an engaging hole formed on the socket board or the adapter;

wherein by moving the adapter backward, the pulling means pulls the socket board in a direction in which the socket board is separated from the motherboard, wherein a semiconductor component to be tested is placed on the socket board so that test signals are supplied to the semiconductor component through the socket board and the motherboard when they are connected with each other, wherein the pulling means has a shaft portion mounted in a protruding manner slidably with respect to the adapter and an bulging portion formed on a tip of the shaft portion and having a diameter larger than that of the shaft portion, wherein the engaging hole of the socket board has a passing hole through which the bulging portion of the pulling means can pass and a sliding hole which is continuous with the passing hole, allows the shaft portion of the pulling means to pass through, and disallows the bulging portion to pass through, and wherein the bulging portion passing through the passing hole of the engaging hole is moved to the sliding hole by sliding the shaft portion thereby to engage with the sliding hole such that the bulging portion can not drop.

2. The system for mating and demating connectors according to claim 1, wherein the adapter has a base portion fixed to the socket board and a sliding portion slidable with respect to the base portion, and wherein the shaft portion of the pulling means is mounted in a protruding manner on the sliding portion of the adapter.

3. The system for mating and demating connectors according to claim 1, wherein the adapter has a fixing means for fixing the sliding portion such that the sliding portion can not slide with respect to the base portion.

4. The system for mating and demating connectors according to claim 1, wherein the bulging portion of the pulling means is formed in a substantially spherical shape.

* * * * *